United States Patent [19]

Harrison

[11] 4,425,667

[45] Jan. 17, 1984

[54] PROTECTIVE VEST APPARATUS

[75] Inventor: James M. Harrison, Westwego, La.

[73] Assignee: Extra Technical Services, Spring, Tex.

[21] Appl. No.: 351,108

[22] Filed: Feb. 22, 1982

[51] Int. Cl.[3] ..... A41D 13/00

[52] U.S. Cl. ..... 2/2; 2/2.5

[58] Field of Search ..... 2/2, 2.5, 102

[56] References Cited

U.S. PATENT DOCUMENTS

| | | | |
|---|---|---|---|
| 3,146,461 | 9/1964 | Kavanagh | 2/2 |
| 3,162,861 | 12/1964 | Gustafson | 2/2 |
| 3,514,786 | 6/1970 | Terwilliger | 2/2.5 |
| 4,158,242 | 6/1979 | Mitchell | 2/2 |
| 4,322,859 | 4/1982 | Mitchell | 2/2 |

FOREIGN PATENT DOCUMENTS

| | | | |
|---|---|---|---|
| 2069318 | 8/1981 | United Kingdom | 2/2.5 |

*Primary Examiner*—Louis Rimrodt
*Attorney, Agent, or Firm*—Charles C. Garvey

[57] ABSTRACT

A protective vest for use by motorcycle riders, snow mobile riders, rodeo riders and the like provides an integral inner vest of cushioned material such as foam having a vertical opening at the front portion thereof and a pair of arm openings allowing it to be dorned by a wearer. A lowermost circumferential armor plate of hardened plastic, for example, extends from the vertical opening 360° degrees around the wearer and vertically from the lowermost portion of the vest upwardly a distance terminating at the middle portion of the vest. The hardened armor plate is bonded, for example, directly to the innermost foam vest. A pair of bilaterally symmetrical hardened plates extend from the mid portion of the vest upwardly over the shoulder of the vest and downwardly onto the back portion thereof forming a pair of bilaterally symmetric continuous armor plated panels separate from the lowermost panel and from each other. A hingedly attached front plate is affixed to the lowermost portion of the vest and is securedly fastened by means of a web belt type connection, for example. An enlarged annular raised portion surrounds the neck of the wearer and can be integral with the foam vest. A pair of spaced apart bilaterally symmetrical shoulder plates are movably attached to the vest body by means of webbing, for example, and provide the straps for securing the shoulder pads to the arms of the wearer for movement therewith.

10 Claims, 4 Drawing Figures

PROTECTIVE VEST APPARATUS

BACKGROUND OF THE INVENTION

1. Field of the Invention

The present invention relates to protective clothing such as is used by motorcycle riders, rodeo riders, football players, snow mobile riders and the like. Even more particularly, the present invention relates to a foam vest article of protective clothing having outermost armor plate in segmented portions spaced about the vest for the transmission of shock in a distributed fashion to the wearer forming protection thereto.

2. General Background

In the motorcycle industry, there is generally provided certain items of protective clothing in the form of helmets, kneepads, mouth guards, and the like. Generally these devices are manufactured of a hardened plastic which protects the rider's head and face area during collisions or when the rider falls from the cycle upon which he is riding. Similar problems face other sportsmen and athletes who ride like instrumentalities or animals which generate necessarily a great deal of speed that might produce injury or death in the event of collision, crash, or the like. Such dangers are apparent in many sporting events such as motocross, motorcycle riding, enduro riding of motorcycles, rodeo, snow mobiling, skiing, and the like.

Many of these sports are active sports requiring mobility and freedom of movement on the part of the participant, lest lack of mobility may cause injury or death on its own. There is a need for a simple, lightweight but protective article of clothing which would protect participants in the above sporting and athletic events from injury in the event of falls, collisions or other such trauma as accompanies such activity.

Most articles of protective wear which are accepted include protection for the head and face but leave exposed the chest and upper torso area. These areas have generally been unprotected because prior art devices have been too cumbersome, offer limited protection and were generally unworkable.

3. General Discussion of the Present Invention

It is thus an object of the present invention to provide an article of clothing in the form of an apparatus for use by wearers who are participants in contact sports, which article affords protection in the form of shock absorption and minimization of injury to the wearer in the area from the neck downwardly to the portion of the torso above the abdomen at the waistline.

The present invention solves these prior art problems and shortcomings by providing an integral vest of lightweight shock absorbing material (as foam) which is covered by a plurality of spaced apart separate armor plates which can be integrally bonded to the foam vest on the outermost surface thereof where they are receptive of shock, trauma, blows, or the like as is generated in active sports events. The present invention further provides a closure for the forwardmost portion of the vest preferably in the form of a hingedly connected hardened plate of material which is affixed to one side of the front face of the vest, crossing the opening at the center forward portion of the vest and affixing during operation to the opposite side portion of the vest thereof by means of a buckle and web belt construction, for example.

Protection for the shoulders and upper arms can be provided in the form of shoulder pads or plate which are movably affixed in a flexible fashion to the vest by means of nylon webbing, for example, and which can be attached for movement with the arms by means of strapping.

It is thus an object of the present invention to provide a protective vest for use by participants in active sporting events which are accompanied by trauma, and physical contact such as, for example, motorcycle riding, motocross, skiing, rodeo, football, automobile racing, and the like.

It is another object of the present invention to provide a protective vest for protection of the torso area of the wearer, for example, from an area adjacent the neck portion of a wearer and extending downwardly to the midsection thereof.

Another object of the present invention is to provide an apparatus for use in the protection of traumatic injury during contact sports which provides an inner cushioned surface abutting the wearer and an outer hardened impact resistant surface in the form of a plurality of panels as receptive of trauma and shock.

Another object of the present invention is to provide a protective vest apparatus which provides full 360° degrees protection to the upper torso and chest area of the wearer.

Another object of the present invention is to provide a protective vest apparatus having particular utility to the participant of contact sports such as motorcycling, skiing, automobile racing, and the like.

Another object of the present invention is to provide a protective vest apparatus for use by participants in contact sports which is effective in maximizing protection against trauma while minimizing restriction of movement of the wearer.

Another object of the present invention is to provide an apparatus of protective clothing for use in contact sports which provides exceptional shock absorbing ability even in high speed contact as accompanies extremely hazardous sports such as motorcycling, motocross, and the like where impact with immovable objects such as trees is an ever present risk to the participant.

It is another object of the present invention to provide an article of protective clothing for use by wearers who are participants in contact sports which article of clothing can be fit to a variety of body sizes and shapes and to a variety of sizes and ages of participants including, for example, even small children.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PRESENT INVENTION

Figure 1:
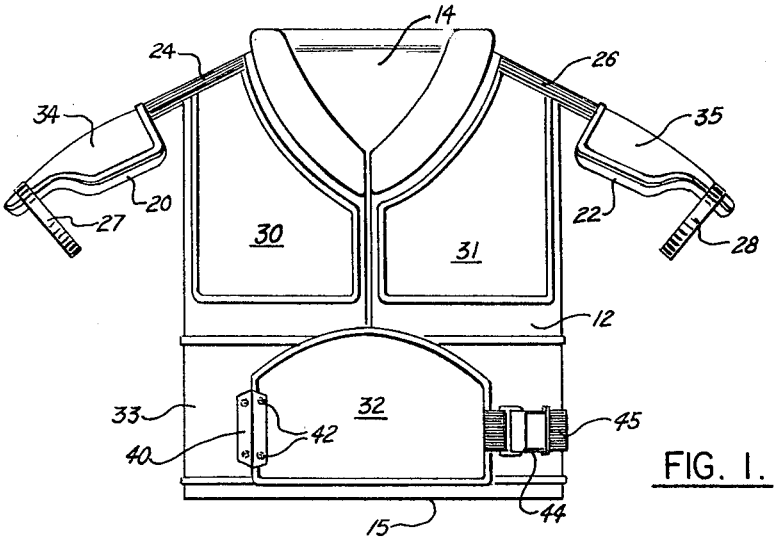
FIG. 1 is a front view of the preferred embodiment of the apparatus of the present invention.
Figure 2:
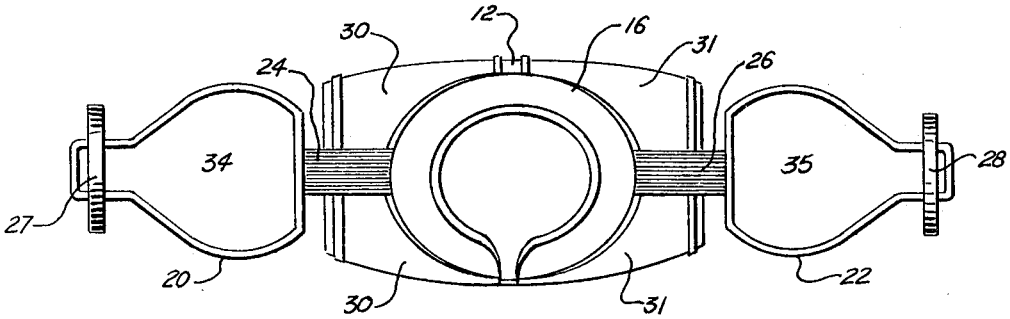
FIG. 2 is a top view of the preferred embodiment of the apparatus of the present invention.
Figure 3:
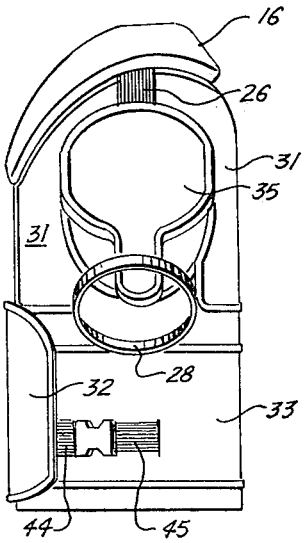
FIG. 3 is a side view of the preferred embodiment of the apparatus of the present invention.
Figure 4:
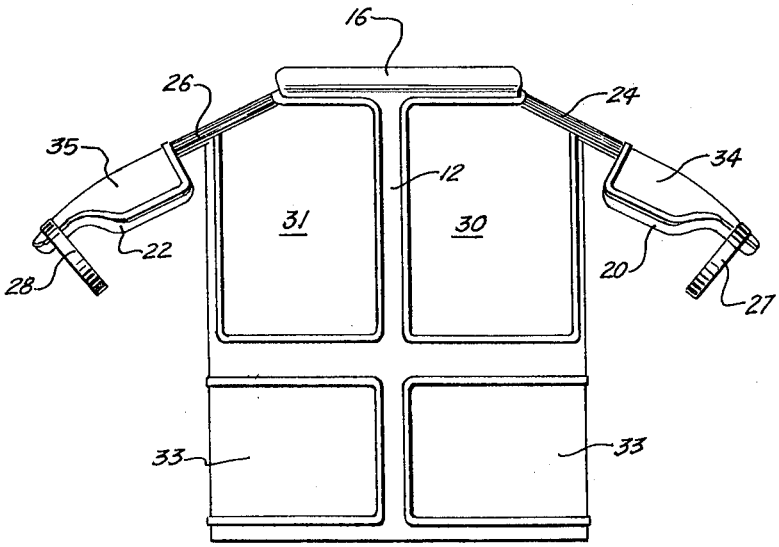
FIG. 4 is a rear view of the preferred embodiment of the apparatus of the present invention.

FIG. 1 best illustrates the preferred embodiment of the apparatus of the present invention providing a vest 10 which is comprises generally of a innermost foam vest body 12 which extends from the neck 14 portion thereof downwardly to a waist 15 area at its lowermost terminus. Vest 12 would be of an integral foam construction, for example, providing a collar 16 which would be raised to provide extra protection to the neck area. A pair of bilaterally symmetrical shoulder pad portions 20, 22 are hingedly or movably connected to vest 10 by means of strapping 24, 26 while each shoulder pad portion provides its own strap 27, 28 which would be normally circular and detachable by means of a grip, velcro, fastener, buckle, or the like, so that it could be secured to the upper arm of a wearer for movement therewith. Thus, protection would be provided to the upper arm while allowing freedom of movement acceptable to the wearer.

A plurality of separate hardened plate panels 30–33 would be provided which would be of a hardened plastic such as ABS plastic or the like. Such panels 30–33 would be bonded by glue or like means as hereinafter disclosed directly to the foam vest and would remain apart thereof. During operation, it will be appreciated that shock transmitted to any one of the panels 30–32 would be distributed onto the foam vest portion thereof and would minimize trauma to the body of the wearer.

A hinged connection 40 would affix the front belly plate 32 to plate 33 by means of rivets 42, for example, and at the opposite end portion of hinge 40, a buckle 44 and web belt 45 construction would allow a removable type closure.

In the manufacture of the above described apparatus, the first step would be to cut the vest 12 portion collar and shoulder pads out of, for example, one-half inch foam. Vest 12 can be glued together at the shoulders and collar 16 can be affixed to the vest 12 by glue also. Seams between the collar 16 and the vest 12 can be sanded down for smoothness. Then the vest 12 and shoulder pads 20, 22 are preferably coated with any desired colored liquid vinyl.

After coating, the hardened protective plates 30–33 are cut from, for example, one-eighth inch thick ABS plastic.

These outer armor plates include two combination chest and upper back plates 30–33 and a 360° degree lower back and waist plate which protects the lower back and abdomen area of the wearer. Shoulder pad plates 34, 35 are also cut. The chest-upper back plates are preferably one piece, each beginning on the front middle of vest 12 in the vicinity of the bottom of the wearer's rib cage and proceeding up to the shoulder and down to the lower back. In the shoulder area, plates 30, 31 provide a surface for attaching shoulder straps 24, 26 thereto by riveting, for example.

These outer protection plates 30–35 of ABS plastic are then placed in an oven and heated, for example, for approximately two and a half minutes at 550° degrees.

The plates are at that time pliable when removed from the oven and can be molded to the curvature of the shoulders (pads 34–35), stomach (pads 32–33), and upper torso (pads 30–31) as desired and formed in the desired shape so as to fit vest 12 itself. The chest, upper back, and lower back areas of the wearer are then provided with protection by bonding the hardened ABS plastic directly to the vinyl coated foam vest 12. Belly plate 32 is then riveted, for example, to the front of the jacket 10 with a plastic hinge construction as shown in the drawings. The other side of the belly plate is equipped with buckle assembly 44, 45. The shoulder pads 20, 22 are attached to the vest 12 using, for example, two-inch straps of nylon webbing 24, 26 and rivets. Adjustable straps 27, 28 with snap fasteners, for example, are provided to secure the shoulder pads 20, 22 to the arms of the rider or wearer.

The foam vest can be, for example, a highly shock absorbent material such as, for example, closed cell one-half inch foam as is manufactured by Uniroyal under the name "Ensolite".

The plastic plate panels can be a one-eighth inch flexible yet tough puncture resistant material such as ABS plastic which stands for Acronitrile-Butadiene-Styrene.

The vinyl coating is a highly abrasion resistant vinyl lacquer. It maintains a high gloss luster.

The web strapping can be one-inch and two-inch, for example, width by one-sixteenth inch thickness polypropelene webbing and can be sown using heavy nylon thread.

The glue useful in adhering the ABS plastic plate panels 30–35 to foam vest 12 is a weather resistant flexible glue such as, for example, methyl ethyl keytone (MEK).

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A protective vest to protect the user from traumatic blows and thrusts from sharp objects to the upper body and stomach area, comprising:

a. an inner body formed of a bendable foamed material extending from the lower neck to the waist of the wearer and encircling the torso, the vest providing a single front vertical opening communicating with an opening for the wearer's neck, and two openings for the wearer's arms spaced laterally from the neck opening;

b. at least one first hardened armor plate panel affixed to the vest body outer surface and covering at least the upper chest, shoulders, and upper back portions of the vest body;

c. at least one second hardened armor plate panel affixed to the vest body outer surface below and spaced from the first armor plate panel and extending substantially around the vest body terminating circumferentially at the vertical opening and located below the first panel upper plates and at the lower edge of the vest body so that the second panel protects the lower back and stomach areas and can flex relative to the first panel in response to movement of the wearer's body; and d. armored closure means extending across at least the lower portion of the vertical opening for holding the vest in a closed position, and protecting the stomach area from sharp objects penetrating the vertical opening, the closure means being releasably connected to the vest on at least one side of the vertical opening.

2. The vest apparatus of claim 1 wherein said vest body is closed cell foam.

3. The vest apparatus of claim 1 wherein said upper armor plates, said belt plate and said belly plate are Acronitrile-Butadiene-Styrene (ABS) plastic.

4. The vest apparatus of claim 3 wherein said plates are bonded to said vest body by glueing.

5. The vest apparatus of claim 4 wherein said plates are bonded to said vest body by glueing with methyl ethyl keytone.

6. The vest apparatus of claim 1 further comprising a pair of bilaterally symmetrical shoulder pads each flexibly attached to said vest body at the shoulder portion thereof.

7. The vest apparatus of claim 6 wherein each shoulder pad is attached to the vest body with flexible strap.

8. The vest apparatus of claim 7 wherein each of the shoulder pads is provided with an arm strap for attaching each of the pads to the associated arm of the wearer.

9. The vest apparatus of claim 1 further comprising a raised collar affixed to the vest body at the neck opening portion thereof.

10. The vest of claim 1, wherein the closure means is hingedly connected on one side of the vertical opening, and buckle means for releasably connecting the closure means to the vest on the other side of the vertical opening.

* * * * *